US007575635B2

(12) United States Patent
Perttilä et al.

(10) Patent No.: US 7,575,635 B2
(45) Date of Patent: Aug. 18, 2009

(54) APPARATUS FOR APPLYING GLUE ONTO AN ADVANCING PLANAR OBJECT

(75) Inventors: Marko Perttilä, Nastola (FI); Petri Kymäläinen, Nastola (FI); Ari-Pekka Tiusanen, Nastola (FI)

(73) Assignee: Raute Oyj, Nastola (FI)

( * ) Notice: Subject to any disclaimer, the term of this patent is extended or adjusted under 35 U.S.C. 154(b) by 22 days.

(21) Appl. No.: 11/566,518

(22) Filed: Dec. 4, 2006

(65) Prior Publication Data

US 2007/0119368 A1 May 31, 2007

Related U.S. Application Data

(63) Continuation of application No. PCT/FI2005/050192, filed on Jun. 3, 2005.

(30) Foreign Application Priority Data

Jun. 4, 2004 (FI) ..... 20040770

(51) Int. Cl.
*B05C 3/02* (2006.01)

(52) U.S. Cl. ..... 118/411; 118/315

(58) Field of Classification Search ..... 118/325, 118/315, 411; 425/463, 382.4; 239/556, 239/124, 127, 112, 581.1; 156/578, 440
See application file for complete search history.

(56) References Cited

U.S. PATENT DOCUMENTS

| | | | | |
|---|---|---|---|---|
| 4,119,058 | A | 10/1978 | Schmermund | |
| 4,529,103 | A | 7/1985 | Drzevitzky et al. | |
| 4,550,681 | A * | 11/1985 | Zimmer et al. | 118/410 |
| 5,490,879 | A * | 2/1996 | Corradi et al. | 118/212 |
| 6,024,299 | A | 2/2000 | Drozkowski | |
| 6,395,088 | B1 | 5/2002 | Zeiffer | |
| 6,464,785 | B1 | 10/2002 | Puffe | |
| 7,169,228 | B2 * | 1/2007 | Schneider | 118/325 |
| 2003/0173429 | A1 | 9/2003 | Puffe | |

FOREIGN PATENT DOCUMENTS

DE 19854634 2/2000

OTHER PUBLICATIONS

International Search Report No. PCT/FI2005/050192, dated Jul. 22, 2005, 3 pgs.

* cited by examiner

*Primary Examiner*—Brenda A Lamb
(74) *Attorney, Agent, or Firm*—Connolly Bove Lodge & Hutz LLP

(57) ABSTRACT

An apparatus for applying glue onto a moving, plane object comprises inlet pipes of the glues a dispenser extending across the path of travel of the object of the dispensing, dispensing nozzles of the glue and means for controllably opening and interrupting the glue flow to the nozzles. The means for interrupting the flow comprise a cylindrical case formed into the frame of the dispenser, extending along the total length thereof, inlet channels for the glue leading to the case, nozzle channels leading out from the case and a pipe element mounted into the case with a sliding fit, said pipe element being equipped with openings for forming a flow connection between the inlet channels of the glue and the nozzle channels in one position of the pipe element with respect to the frame and for closing said flow connection in the second position of the pipe element with respect to the frame.

12 Claims, 6 Drawing Sheets

APPARATUS FOR APPLYING GLUE ONTO AN ADVANCING PLANAR OBJECT

Figure 1:
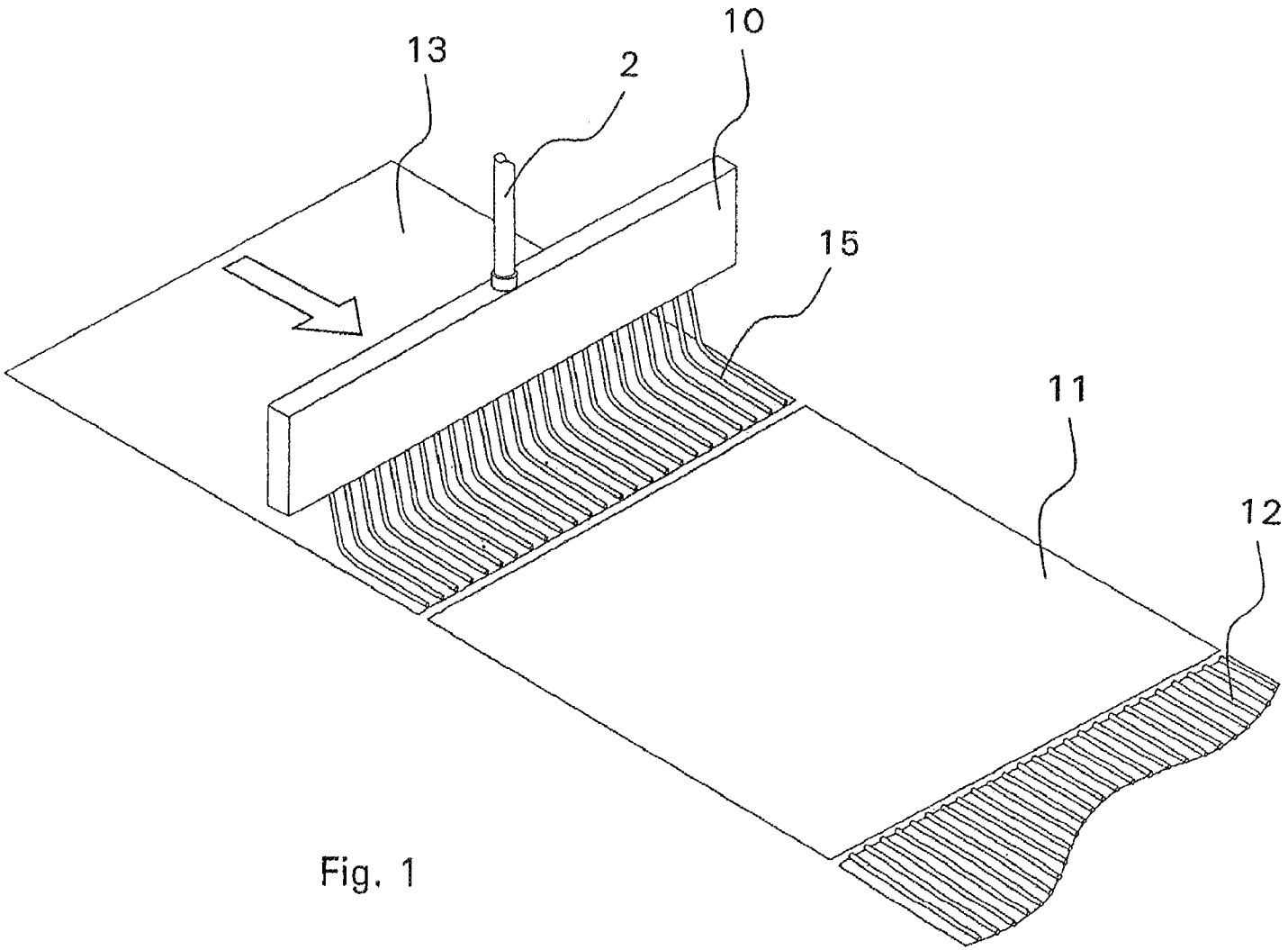

This application is a continuation of PCT/FI2005/050192, filed Jun. 3, 2005, which claims priority to Finnish application FI 20040770, filed Jun. 4, 2004.

The present invention concerns an apparatus for applying glue onto a plane object being in a progressive movement. Primarily the apparatus is meant for applying glue onto wood veneers, which after the dispensing of the glue are led to the following steps of the manufacturing of plywood plates. It is also applicable to other corresponding usages like lamination of boards. The glue is usually applied in a foamed state from a pressurized glue dispenser. The basic part of the dispenser is formed by a tubular or a box-like element extending across the path of travel of the object to be glued. The glue is led to the dispenser, from where it is run under pressure through nozzles located across the dispensing area, at a distance from each other. Especially in the manufacturing of plywood, the future location of the veneer in the plywood construction must be taken into consideration for the part of the veneers to be glued, and the dispensing of glue must be controlled accordingly. The veneer for the top layer of the construction is left without glue and there must not be any specks of glue on the surface thereof.

A clean top veneer of the finishing layer in the plywood production lines of prior art is achieved so that the top veneer of the finishing layer is led to the composing of veneers bypassing the gluing apparatus, and only the veneers to be glued, in other words the veneers for the intermediate layers and the lower finishing layer are led through the gluing apparatus. The arrangement is complicated in its construction and operation. With the apparatus in accordance with the present invention for gluing, the composing is performed so that all the veneer sheets can be led in an appropriate order as a successive row to the composing, the whole row passing uniformly through the gluing apparatus. The veneer sheets can be glued controlled so that the glue will be applied only onto the surface of the suited sheets, without a risk of foul of the top veneer with glue, which forms the finishing top layer of the plywood.

Essential for the regulation of the dispensing of glue accurately only to the surfaces of certain veneer sheets is the operation of those elements of the apparatus, which are used for interrupting and reinstating the flow of the glue to the dispensing nozzles. With the present invention, this accuracy is provided by means of a glue dispensing apparatus as described in the appended independent Claims. Further features of the apparatus are disclosed in the dependent claims.

When the element for opening and closing the glue flows, respectively, is formed as a hollow tubular element having walls provided with openings for connecting the inside of the tubular element on one hand with the inlet channels of glue and on the other hand with the channels leading the glue to the nozzles, the pressure fluctuation occurring usually in connection with the opening and closing of the glue flow can be eliminated substantially better than in the devices of prior art, based primarily on opening and closing of the nozzle channel, respectively. Further, the construction in accordance with the present invention makes it possible to keep the glue flow going in a substantial portion of the flow channels in situations, where the flow to the nozzles is interrupted.

The hollow tubular element serving as an opening and closing element and leading to the dispensing nozzles also makes it possible to combine all the parallel glue flows as near to the nozzles as possible, so that the pressure differences eventually present between the different lines can be balanced during the operation of the glue dispensing as well as when the dispensing is interrupted, which assists the even dispensing of glue through the nozzles.

In accordance with one significant special feature of the invention, as disclosed in the enclosed dependent claim 6, the operation of the gluing apparatus can also be regulated so that the dispenser can be adapted to different widths of the veneer sheets.

Figure 2:
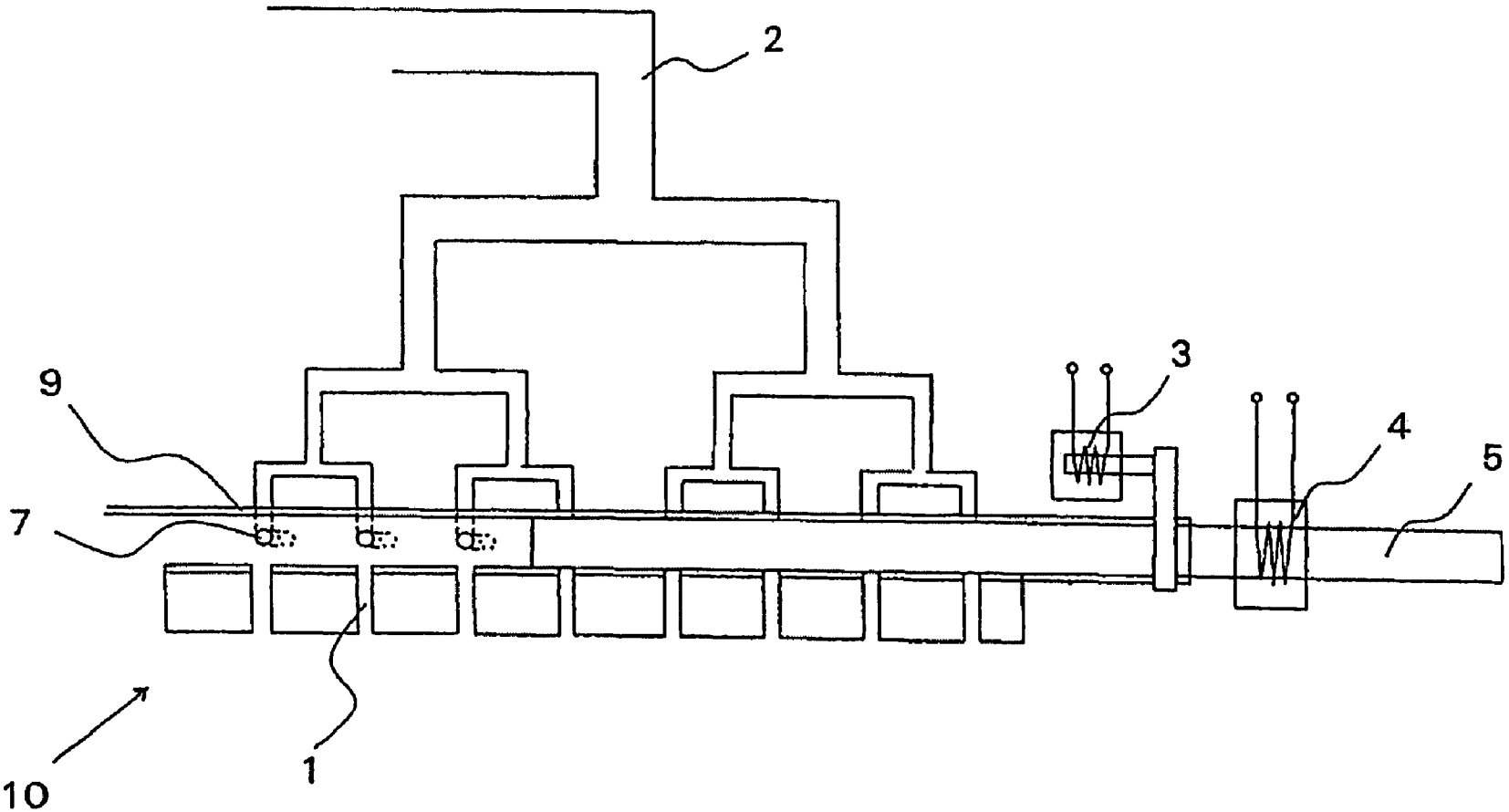
Figure 3:
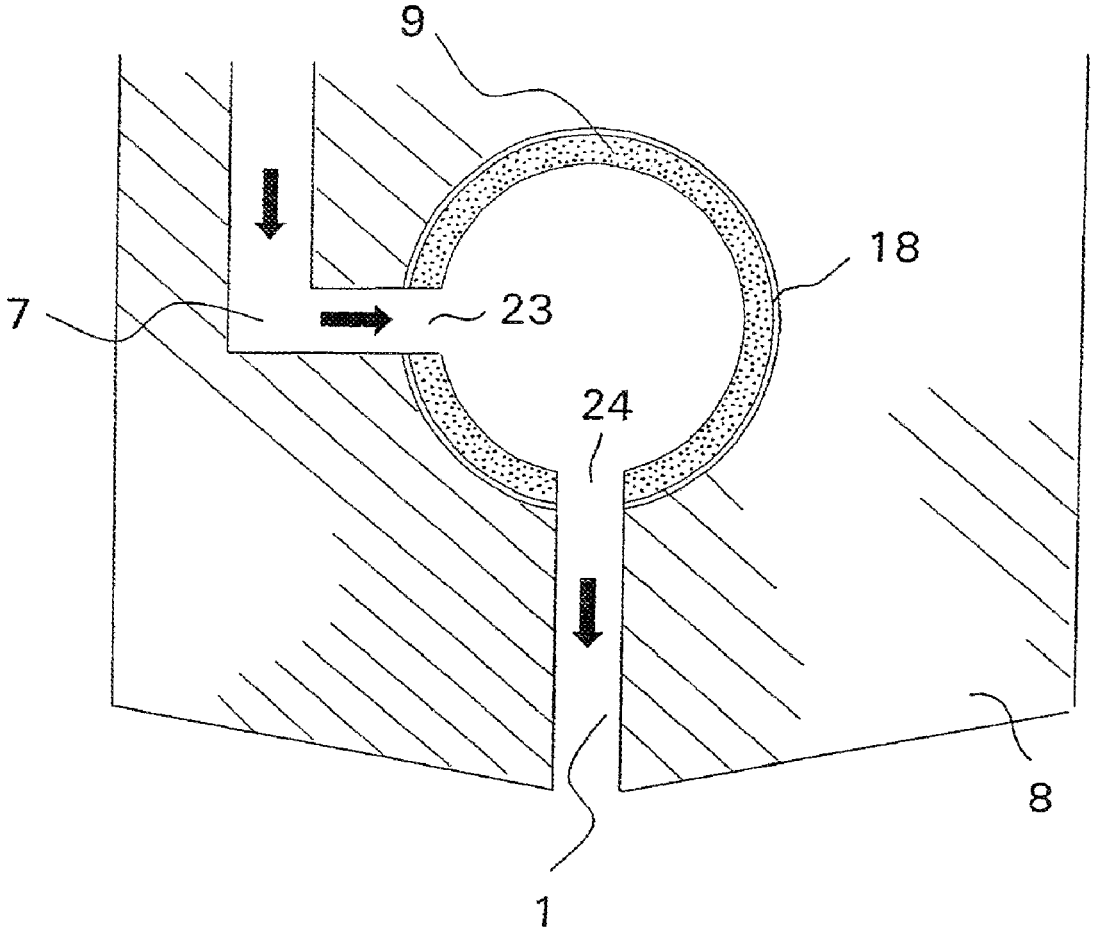
Figure 4:
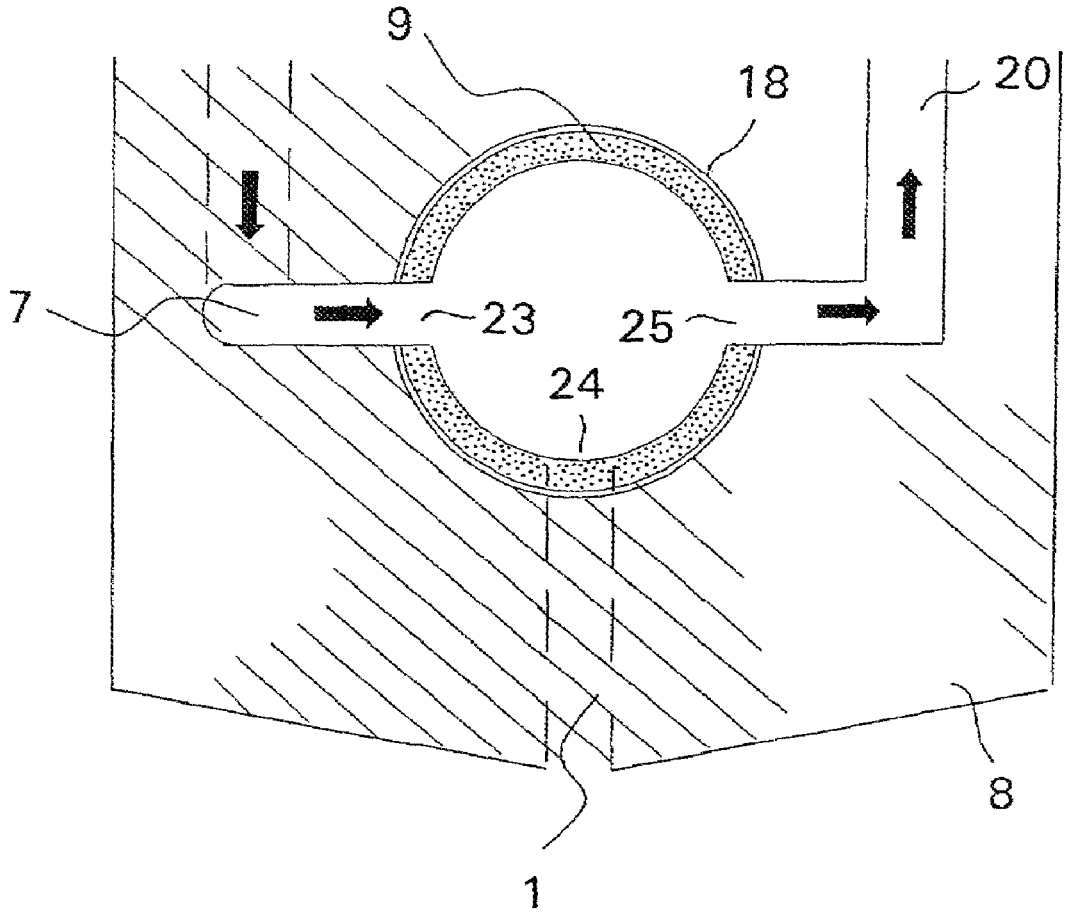
Figure 5:
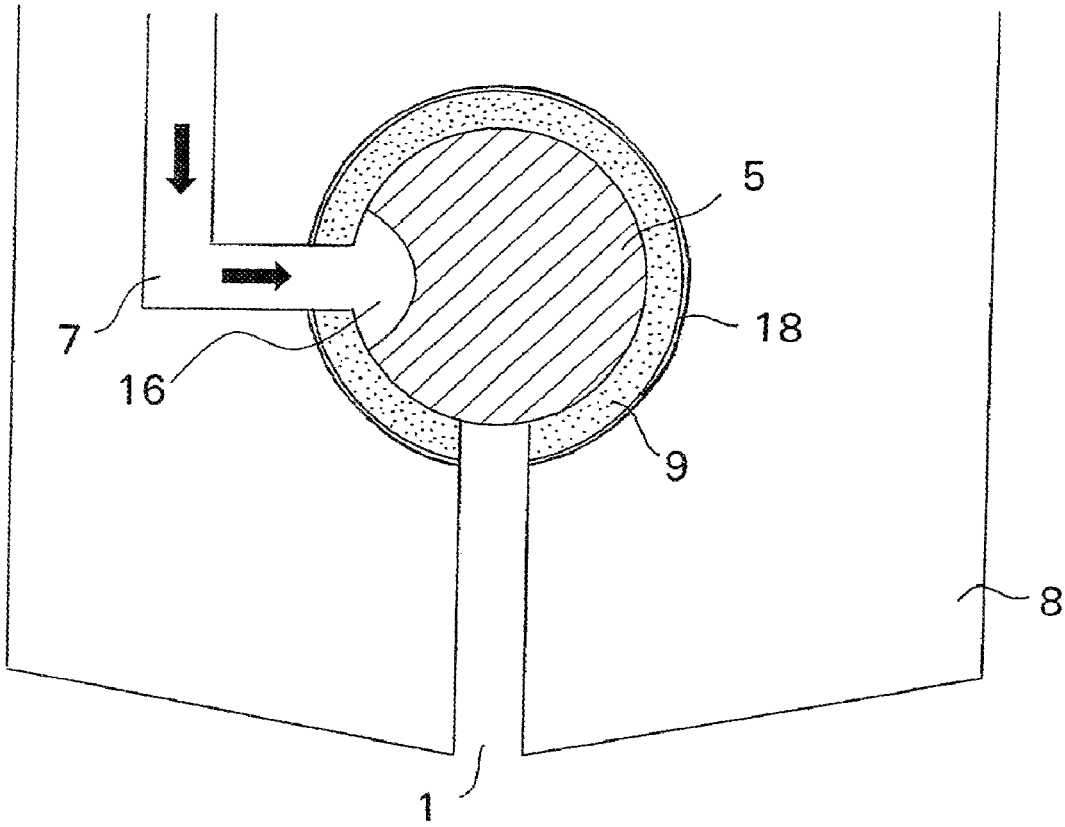
Figure 6:
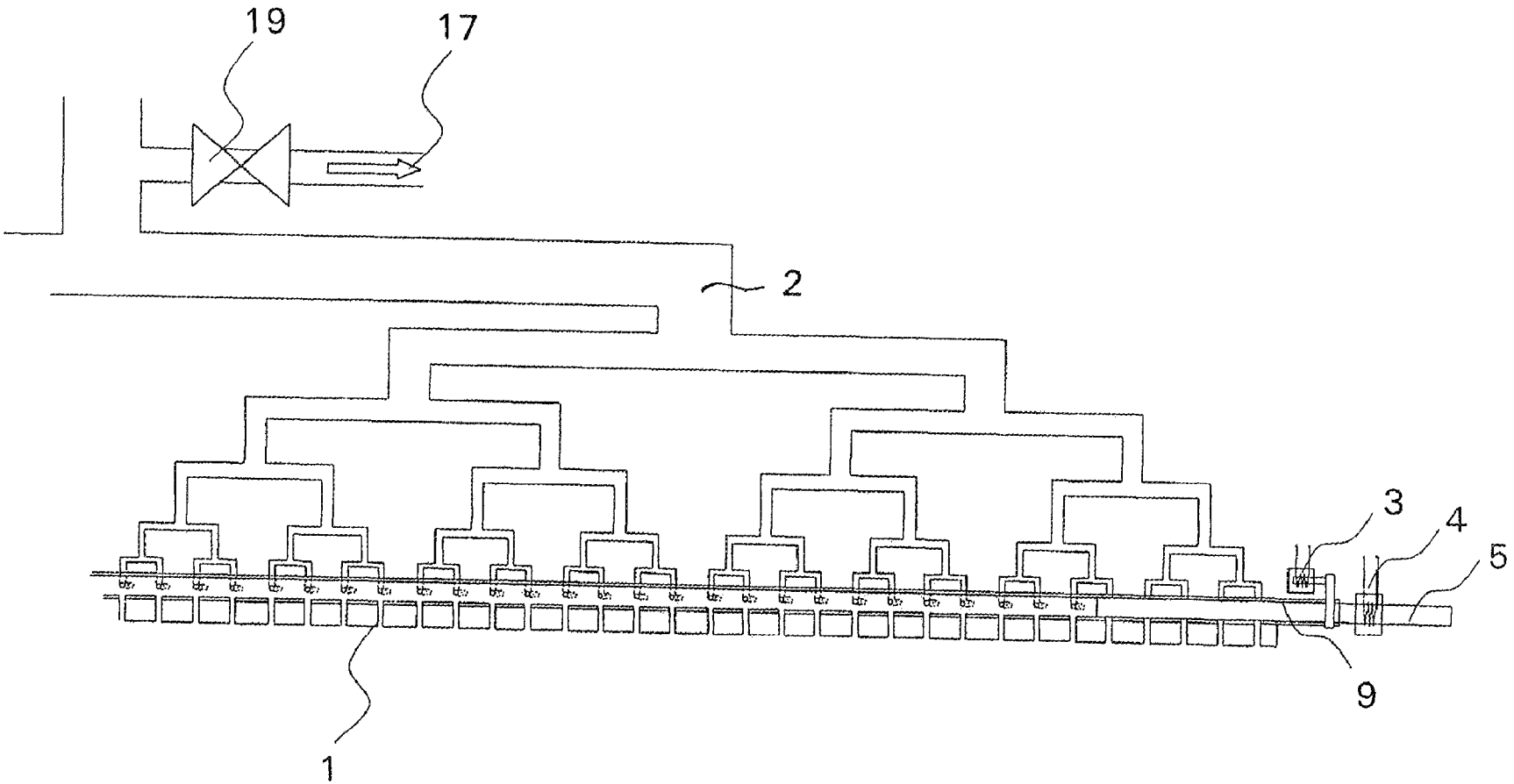

The invention will be described in more detail with reference to the enclosed drawings, wherein FIG. 1 is a schematic view of the operation of the gluing apparatus, FIG. 2 is a schematic view of the basic elements of the gluing apparatus in accordance with the present invention, FIG. 3 is a cross-sectional view of a detail of the dispenser in the dispensing position, FIG. 4 shows the corresponding detail as an alternative embodiment in a closed position of the dispenser, FIG. 5 illustrates one additional embodiment of the apparatus in accordance with the present invention, and FIG. 6 illustrates one additional embodiment of the invention.

FIG. 1 shows schematically a gluing apparatus for manufacturing of plywood, wherein the veneers proceed to an apparatus for plywood composing. Reference numeral 12 indicates a glued veneer, which is a veneer to be positioned to an intermediate layer of the composition. The next veneer proceeding to the composition is veneer 11 to form the top layer of the plywood, onto which no glue has been applied. Veneer 13 arrived under the gluing apparatus 14 is the surface veneer for the bottom. The gluing step of veneer 12 must be interrupted controlled, exactly at the back edge of said veneer so that no glue can come onto the next veneer 11. On the other hand, the dispensing of glue must be started accurately at the moment when the front edge of veneer 13 has arrived under the gluing apparatus 14.

Constructions for providing the control of an accurate dispensing for the gluing apparatus are described with reference to the following drawings. FIG. 2 shows the basic constrictions of the apparatus. General reference 10 indicates the dispenser forming the basic part of the gluing apparatus. The frame of the dispenser is substantially a solid beam 8, a channel 18 being formed into it, extending in the longitudinal direction through it. In this embodiment of the invention, the channel is a straight cylinder. The beam 8 extends in the transversal direction across the path of travel of the veneer sheets.

The beam 8 is equipped with inlet channels 7 leading to the channel 18. There is a plurality of inlet channels positioned along the length of the beam 8, and the channels are connected with the inlet pipes 2 for the glue. With this arrangement the glue supply can be distributed evenly to the channel 18. Nozzle channels 1 lead from the channel 18 to the lower part of the beam, the glue being run or extruded through said channels onto the surface of the veneer passing under it. The channels 1 are also distributed evenly spaced along the length of the beam 8, taken into consideration the intended work width of the gluing apparatus. The number of inlet channels 7 for the glue is preferably the same as the number of nozzle channels 1, and inlet channels 7 are located to open to the channel 18 aligned with the outlet port of the nozzle channels 1 in the longitudinal direction of the channel.

A pipe 9 is mounted into the channel 18 with a sliding fit, said pipe extending over the total length of the channel 18. Flow ports 23 and 24 have been formed into the wall of the pipe 9 at the points that in a certain position of the pipe with respect to the frame 8 can be adjusted so that these ports are aligned with the openings of the inlet channels 7 and the nozzle channels 1. Thereby the glue coming from the channels 7 under pressure has entry to the nozzle channels 1 and further onto the surface of the veneer. For interrupting the running of the glue, the pipe 9 in the channel 18 is either movable in the axial direction or it can be rotated about its longitudinal axis. With this axial motion or rotating motion, the pipe 9 is movable in the channel 18 so that the wall of the pipe closes the outlet openings 24 of the channels 1, as well as the openings 23 of the inlet channels 7, or alternatively affects the flow through the opening 23. The axial motion of the pipe 9 can be achieved quickly and with an adequate length for example by means of a solenoid actuator, that is schematically shown in FIG. 2, marked with reference numeral 4.

An alternative closing operation of the apparatus is shown in FIG. 4. In this embodiment, there are outlet channels 20 in addition to the nozzle channels 1 formed into the frame 8. Correspondingly, there are openings 25 formed into the inner wall of the pipe 9 and located so that when the opening 24 of the nozzle channel is closed, the opening leading to the bypass channel 20 is open. The opening 23 of the inlet channel is dimensioned and located so that it allows flow into to the inside of the pipe in both of the locations or positions of the pipe 9. The operation in accordance with FIG. 4 can be achieved for example with an axial motion of the pipe 9 and by forming the opening 23, or respectively the outlet opening of the inlet channel 7 in the axial direction of the pipe 9 so, that the inflow of the glue is possible when the pipe 9 closes either the opening 25 or the opening 24. A corresponding operation is naturally also achievable by a rotational motion of the pipe 9 by locating the openings 23, 24 and 25 mutually in an appropriate way and/or by forming necessary additional openings to the wall of the pipe 9. For the part of the opening 23, however, it must be taken into consideration that it closes or restricts the flow-through at least momentarily, and respectively opens in a suitable synchronization with the closing and opening of the opening 24, respectively, for controlling the pressure impacts in the pipe 9.

The quickness and intensity of the glue flow in different operating situations either from the openings 24 in the embodiment of FIG. 3, or from the openings 24 and 25 in the embodiment of FIG. 4, can be constrained or speeded up by adjusting the inlet opening 23 of the closing element 9 with respect to its location and size to be flow-technically compatible with the corresponding outlet opening 24 and 25.

In the embodiment in accordance with FIG. 4, the glue flow can be made to continue also when the dispensing is interrupted, to avoid the clogging of the channels. In addition, this arrangement helps to maintain a constant pressure at the supply. Further, the bypass channels 20 can be used for washing of the apparatus, whereby washing fluid can be made to circulate through the channels 7, the inside of the pipe 9 and the bypass channels 20.

The return flow can naturally be provided through the pipe 9, from one or from both of its ends, whereby channels 20 are not necessarily required. This arrangement is also possible in the embodiment in accordance with FIG. 3.

FIG. 2 also shows the width adjustment option for the glue dispensing. Inside the pipe 9, through one end thereof, there is located a sack pipe 5 extending from said one end of the pipe to a determined depth in the pipe 9. The depth of penetration of the sack pipe in the pipe 9 is adjusted by means of a coil 4 so that a desired amount of nozzles, starting from said end of the pipe, are totally closed out of the operation. For avoiding the clogging of the inlet channels 7, the sack pipe 5 can have a groove 16 extending in the longitudinal direction thereof, through which the glue can be recirculated to the supply means of glue for the part of the closed nozzle channels 1. The arrangement in accordance with FIG. 5 is applicable especially in a basic application of the invention, shown in FIG. 3. In the embodiment of FIG. 4, the sack pipe 5 can be equipped with channels for connecting the channels 7 and 20 at the points, where the channel 24 is closed by the sack pipe 5, and when the gluing apparatus has the corresponding limitation of the width of operation.

Pressure impacts occurring in the dispensing of glue can be to some extent controlled also by means of an arrangement in accordance with FIG. 6, where a tapping 17 is located in the glue inlet pipe 2, said tapping 17 being equipped with a relief valve 19.

The invention claimed is:

1. An apparatus for applying glue onto a planar object, the planar object advancing essentially horizontally along a path of travel, said apparatus comprising a beam having an extension length across said path of travel and being provided with internal glue flow channel means, glue inlet pipes distributed over the length of the beam to communicate with said internal flow channel means, application nozzles distributed over the length of the beam and communicating with said glue flow channel means, the internal glue flow channel means comprising a cylindrical case formed into the beam and extending along the total length thereof, a pipe element provided into the cylindrical case and mounted into the case with a sliding fit to extend along the case length, the pipe element being equipped with openings for forming a constant in-flow connection from said glue inlets pipes into the pipe element, as well as openings for forming an out-flow connection from the pipe element to the application nozzles in one position of the pipe element in the case for closing said out-flow connections in another position of the pipe element in the case, wherein said pipe element is provided at least from one end thereof with a return flow for the glue through the pipe in the position of the pipe element where the application nozzles are closed.

2. An apparatus in accordance with claim 1, wherein the change of the position of the pipe element in the case is arranged by means of an axial motion of the pipe element in the case.

3. An apparatus in accordance with claim 2, wherein a closing element is located with a sliding fit inside the pipe element and extending for a part of the length of the pipe element from the one end thereof, said closing element closing the application nozzles in a penetration distance of the closing element.

4. An apparatus in accordance with claim 1, wherein the change of the position of the pipe element in the case is arranged by means of a rotational motion of the pipe element in the case.

5. An apparatus in accordance with claim 4, wherein a closing element is located with a sliding fit inside the pipe element and extending for a part of the length of the pipe element from the one end thereof, said closing element closing the application nozzles in a penetration distance of the closing element.

6. An apparatus in accordance with claim 1, wherein a closing element is located with a sliding fit inside the pipe element and extending for a part of the length of the pipe element from the one end thereof, said closing element closing the application nozzles in penetration distance of the closing element.

7. The apparatus in accordance with claim 1, wherein the planar object is veneer.

8. An apparatus for applying glue onto a planar object, the planar object advancing essentially horizontally along a path for travel, said apparatus comprising a beam having an extension length across said path of travel and being provided with internal glue flow channel means, glue inlet pipes distributed over the length of the beam to communicate with said internal flow channel means, application nozzles distributed over the length of the beam and communicating with said glue flow channel means, the internal glue flow channel means comprising a cylindrical case formed into the beam and extending along the total length thereof, a pipe element provided into the cylindrical case and mounted into the case with a sliding fit to extend along the case length, the pipe element being equipped with openings communicating with said inlet pipes as well with opening communicating with said application nozzles for forming an in-flow connection from said glue inlet pipes into the pipe element, as well as an out-flow connection from the pipe element to the application nozzles in one position of the pipe element in the case and for closing said flow connections in another position of the pipe element in the case, wherein the beam is equipped with bypass channels leading from the case and the pipe element equipped with openings for providing a flow connection between the inlet pipes and the bypass channels in the position of the pipe element where the application nozzles are closed.

9. An apparatus in accordance with claim 8, wherein the change of the position of the pipe element in the case is arranged by means of an axial motion of the pipe element in the case.

10. An apparatus in accordance with claim 8, wherein the change of the position of the pipe element in the case is arranged by means of a rotational motion of the pipe element in the case.

11. An apparatus in accordance with claim 8, wherein a closing element is located with a sliding fit inside the pipe element and extending for apart of the length of the pipe element from the one end thereof, said closing element closing the application nozzles in a penetration distance of the closing, element.

12. The apparatus in accordance with claim 8, wherein the planar object is veneer.

* * * * *